United States Patent [19]

Miller

[11] Patent Number: 4,747,629

[45] Date of Patent: May 31, 1988

[54] EMERGENCY EXIT LOCK DEVICE

[75] Inventor: Theodore H. Miller, New Britain, Conn.

[73] Assignee: Emhart Industries, Inc., Farmington, Conn.

[21] Appl. No.: 940,198

[22] Filed: Dec. 12, 1986

Related U.S. Application Data

[63] Continuation of Ser. No. 729,198, May 1, 1985, abandoned.

[51] Int. Cl.[4] ..... E05C 21/00

[52] U.S. Cl. ..... 292/92; 292/1; 292/DIG. 66; 292/300; 292/340

[58] Field of Search ..... 292/300, 302, 304, 337, 292/346, 92, 1, DIG. 39, DIG. 40, DIG. 66, 340; 70/92

[56] References Cited

U.S. PATENT DOCUMENTS

| | | | |
|---|---|---|---|
| 1,384,506 | 7/1921 | Blackmore | 292/DIG. 40 X |
| 1,473,076 | 11/1923 | Bonilla | 292/302 X |
| 2,413,732 | 1/1947 | Schlage | 292/337 |
| 3,316,006 | 4/1967 | Russell et al. | 292/337 |
| 3,503,234 | 3/1970 | Schultz | 292/337 X |
| 3,514,983 | 6/1970 | Krook et al. | 292/337 X |
| 3,761,119 | 9/1973 | Bennett et al. | 292/346 |
| 3,831,988 | 8/1974 | Stelma | 292/302 |
| 3,877,262 | 4/1975 | Williams | 292/92 X |
| 4,083,590 | 4/1978 | Folger | 70/92 X |
| 4,178,027 | 12/1979 | Charron | 292/346 |
| 4,189,175 | 2/1980 | Paxton | 292/346 X |
| 4,458,928 | 7/1984 | Hirschbein | 292/346 |
| 4,547,009 | 10/1985 | Allen | 292/346 |

*Primary Examiner*—Richard E. Moore

*Attorney, Agent, or Firm*—Barry E. Deutsch

[57] ABSTRACT

An exit device primarily designed for outwardly opening doors comprises a rigid plate member having mounted thereon a latch-bolt assembly anchored to a door member and a strike assembly mounted on a door frame member in operative association with the latch-bolt assembly, wherein the plate member includes projections positioned to be on each side of the latch bolt of the latch-bolt assembly, and wherein the strike assembly includes recesses for receiving such projections. The recesses in the strike assembly are configured in relation to the projections to allow limited vertical movement of the projections within the recesses. When the device is subjected to a major force such as in a fire the projections will restrict linear growth of the frame member in the latch area by engagement of the projections, with the walls of the recesses thereby preventing excessive strain from occurring on the latch bolt which can lead to disengagement of a latch bolt from the strike. Additionally, the projections limit lateral movement of the strike and door frame member away from the latch-bolt assembly and limit inward movement of the strike and door frame member toward the latch assembly. The exit device, which can be used on single or double doors, is particularly suitable for use on a fire or emergency door.

16 Claims, 4 Drawing Sheets

10
12
14
16
18
20
30
32
34
36
50
54
56
10a
10b
3
5

EMERGENCY EXIT LOCK DEVICE

This is a continuation of co-pending application Ser. No. 729,198 filed on May 1, 1985 now abandoned.

FIELD OF INVENTION

This invention relates to an exit device comprising a latch-bolt assembly mounted on one surface of a door member and a cooperating strike assembly mounted on a door frame member such as a mullion. More particularly, the invention relates to an exit device designed primarily for an outwardly opening metal door which will remain locked when subjected to severe distortions of the kind encountered in a fire or other major force.

BACKGROUND OF INVENTION AND PRIOR ART

It is recognized in the prior art that at times it is desirable, if not essential, to maintain a closure such as a door in a closed condition. For example, when an automobile is involved in an accident it is a common belief that it is best if the doors remain closed to prevent the occupants from being thrown from the automobile onto the roadway or roadside. It has been found, however, that in an accident where the automobile is subjected to substantial force that the doors of the automobile will swing open under the impact of the collision due to distortion of the door frame permitting the door latch to disengage from the door strike. Similarly, emergency or fire doors which preferably are to remain locked during a fire oftentimes spring open due to distortion of the door or door frame member, permitting the door latch to disengage from the door strike. Similarly, distortion and disengagement of door members can occur when excessive force is applied to a door member such as a result of the force of water being applied from a fire hose during a fire.

In the prior art, various attempts have been made to provide exit devices which preclude the accidental opening of a closure such as a door by distortion of a door member. U.S. Pat. No. 2,709,612 is directed to an exit device for use on an automobile door to prevent accidental opening of the door by distortion of the car frame. The disclosed device includes provisions for a door member which projects beyond a free or unhinged edge of the door and cooperating socket means in a doorjamb for reception of the door member when the door is closed. In order to provide the desired interlocking engagement, the outer free or projecting end of the door member is offset from its root portion in a direction vertically and/or inwardly with respect to the cooperating doorjamb to provide an overhang and the socket means is correspondingly formed in the jamb to receive the offset door member. In one preferred form, the closure device includes a lug or dovetail member secured to a free end of the door so as to project outwardly beyond and away from such edge a short distance, this member being adapted and arranged for reception in a cooperating socket member in the frame. Preferably the lug and its cooperating socket are placed as close to the door latch member as is conveniently possible to affect maximum resistance to edgewise separation at that point. U.S. Pat. No. 4,401,330 discloses a locking method of and means for securing or maintaining secured a closure such as a door when the door members are subjected to thermal distortion caused by a fire. It is stated that the opening or disengagement of the door latching device is caused because the door frame member such as a mullion which retains the door strike is fixed at its lower end to the floor and at the upper end to the ceiling. Upon heating the door member attempts to become elongated. However, because of being fixed the door member cannot expand, causing distortion and deformation and subsequent disengagement of the locking or latching device. To avoid this distortion and disengagement, the '330 patent suggests having a free space at either the top or bottom of the frame member so as to permit elongation without distortion. According to the disclosure of the patent a latch mechanism is provided which under normal conditions is always in disengagement but upon elongation due to thermal forces will become engaged and retain the door and door frame such as a mullion in locking relation. U.S. Pat. No. 4,437,693 discloses a latching mechanism which upon the presence of excessive heat as on the occurrence of fire has a cover which melts, allowing a blocking plate to slide into operative position to prevent retraction of the latching means and consequently preventing unlatching of the device. The patent provides for a kit member to enable the utilization of the blocking member in an existing door frame.

Although the aforesaid patents define the problem confronting the present applicant, the solutions to the problem are not completely acceptable because of complexity and/or the need for modifying the closure structure.

PRIMARY OBJECTS AND GENERAL DESCRIPTION OF INVENTION

Accordingly, it is a primary object of the present invention to provide an exit device comprising a latch-bolt assembly and a cooperating strike assembly for locking a closure such as a door which will remain locked when subjected to distorting forces including thermal forces.

It is another object of the present invention to provide an exit device comprising a latch-bolt assembly and a cooperating strike assembly for locking a closure and maintaining the closure locked even when subjected to distorting forces which is simple and inexpensive to manufacture.

These and other objects of the present invention will become apparent from the following general description of the invention and the illustrated presently preferred embodiment as set forth in the drawing.

The objects of the present invention are accomplished by providing an exit device primarily designed for outwardly opening doors which comprises a rigid plate member having mounted thereon a latch-bolt assembly for anchoring to the surface of a door and a strike assembly for mounting on a door frame member or a mullion in operative association with the latch-bolt assembly. The front of the plate member includes projections positioned so that one of the projections will be on each side of the latch bolt of the mounted latch-bolt assembly. The strike assembly includes recesses for receiving the projections. The recesses in the strike assembly are configured in relation to the projections to allow vertical movement of the projections within the recesses by a predetermined distance before striking the walls of the recesses. In the event of a fire or other major distorting force, the projections, while being free to permit limited movement in a vertical direction, will restrict linear growth of the frame in the latch area by engagement of the projections with the walls of the recesses, thereby preventing excessive strain from occurring on the latch bolt which could cause disengagement of the latch bolt from the strike. Additionally, the projections in the recesses will limit the lateral movement of the strike and door frame member away from the latch assembly. The rigid face of the latch-bolt assembly will also limit inward movement of the strike and frame member toward the latch assembly.

Accordingly, in the presently disclosed device the latch-bolt assembly is prevented from becoming disengaged from the strike assembly even when subjected to major forces such as thermal forces caused by a fire, or other physical forces such as an impact from a collision or the like. The exit device of the present invention has application primarily with an outwardly opening door where the latch-bolt assembly is applied to one surface of the door.

THE DRAWING AND PRESENTLY PREFERRED EMBODIMENT

The presently preferred embodiment of the invention is shown in the drawing wherein like parts are referred to by like numbers. In the drawing, FIG. 1 is front elevational view illustrating a closure and wall member utilizing an exit device of the present invention;

Figures 1, 2, 3:
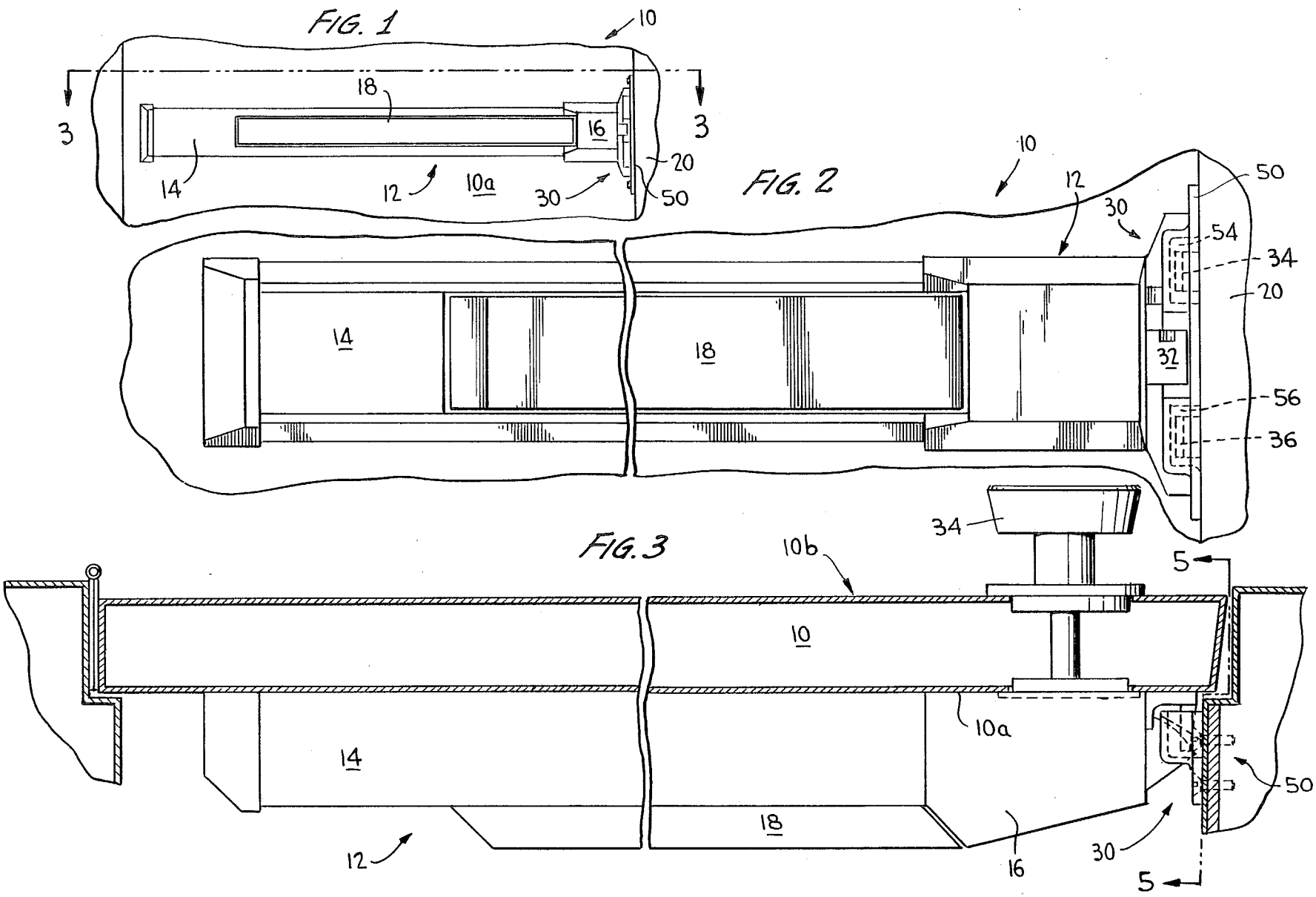
FIG. 2 is an enlargement of a part of the assembly of FIG. 1.
FIG. 3 is a sectional view taken along line 3—3 of FIG. 1.

FIGS. 1–3 illustrate a door 10, an emergency exit lock and actuator assembly indicated generally by reference numeral 12 utilizing the exit device of the present invention. As shown, door 10 has mounted on one surface 10*a* a housing 14 for retaining a latch-bolt assembly indicated generally by reference numeral 30, a cover 16 for latch-bolt assembly 30, and a push-bar 18 for actuating or releasing latch 32 of latch-bolt assembly 30. As seen in FIG. 3, a knob 34 is positioned at surface 10*b* of door 10, with the actuating mechanism therefor extending through the door. Strike assembly 50 is anchored to door frame member or mullion 20 in cooperative association with latch-bolt assembly 30.

It will be understood that although the assembly illustrated includes a knob 34, it may be preferable to simply use an internal lock mechanism, permitting the door to be opened from the outside with a key. At other times it may be desirable not to have either a knob or key mechanism. These aspects are not significant to the presently disclosed and claimed invention.

Figure 4:
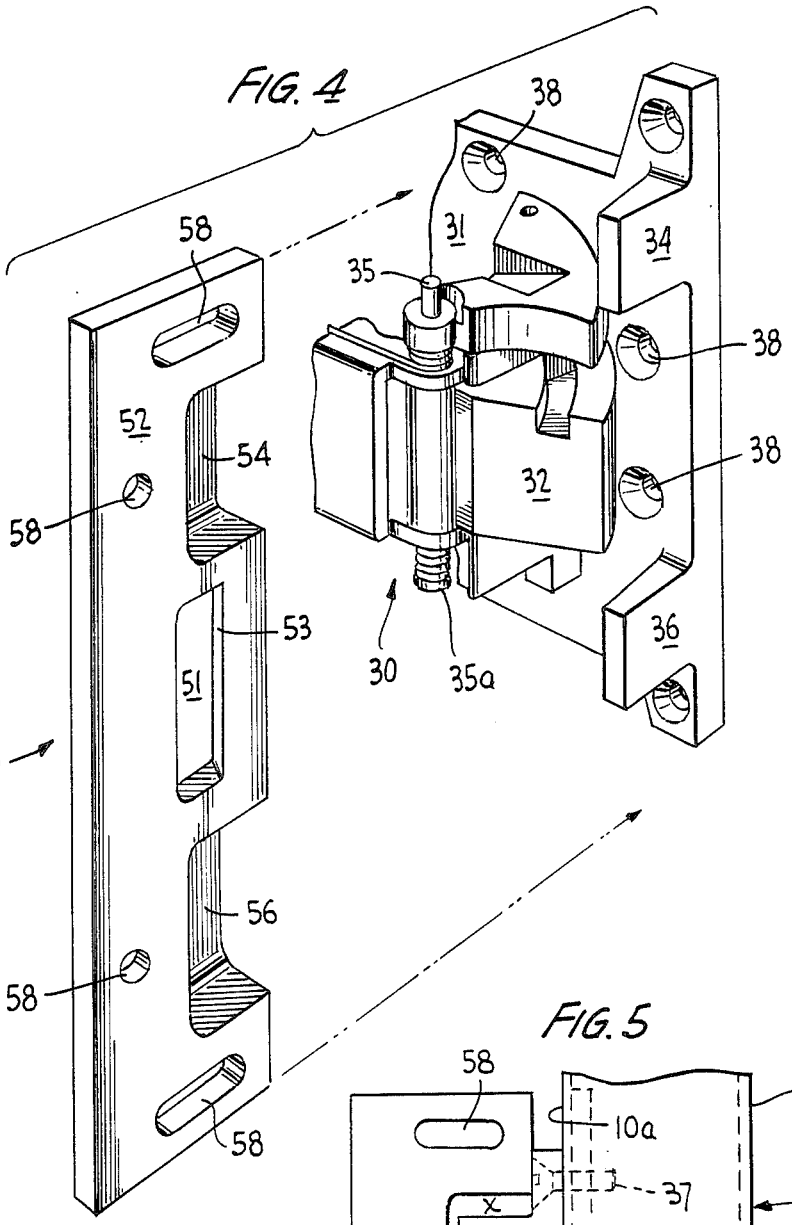
FIG. 4 is an exploded perspective view showing the latch-bolt assembly and strike assembly of the exit device of the present invention.

The exit device, as best seen from FIG. 4, includes latch-bolt assembly 30 and a strike assembly 50. Latch-bolt assembly 30 comprises a front or base plate 31 made of a rigid metal having projections or lugs 34 and 36 extending therefrom, a plurality of mounting holes 38 for mounting the base plate to a door or closure member 10, and a latch-bolt mechanism 40. The latch-bolt mechanism 40 includes a main latch bolt 32 and an auxiliary latch-bolt 33, both pivoting on pin member 35 associated with return spring 35*a*.

Figure 8:
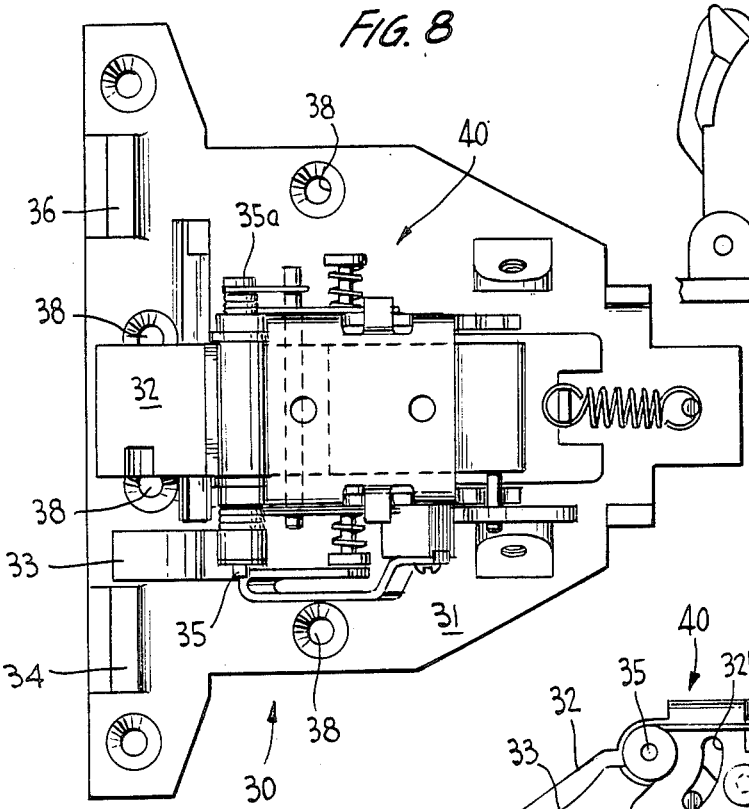
FIG. 8 is is a top view of the latch-bolt assembly for attachment to a door.
Figure 10:
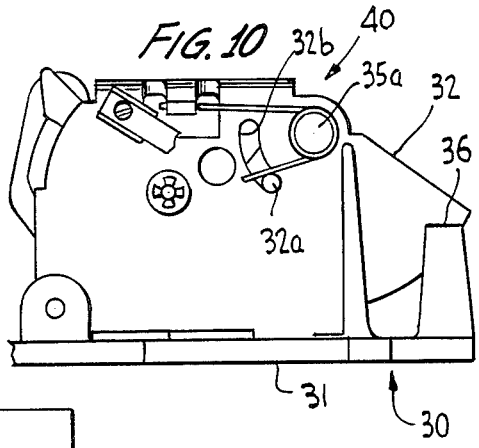
FIG. 10 is a view showing the second side of the latch-bolt assembly, parts thereof being omitted for convenience.
Figure 9:
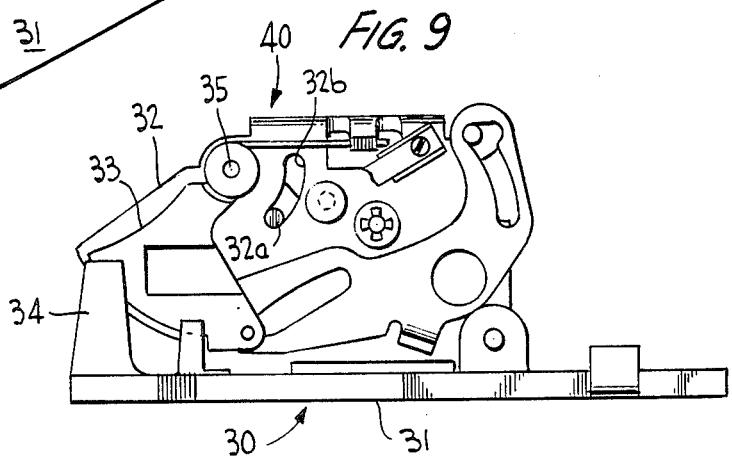
FIG. 9 is a view showing a first side of the latch-bolt assembly, partly fragmented for convenience.

It is to be noted that the base plate 31 is of a heavy, rigid metal with mounting holes thereon, as best shown in FIGS. 8 and 9, being positioned on each side of pivot pin member 35, providing enhanced support preventing twisting of the assembly in the event of a major force such as a fire at a critical point. It is also to be noted that latch bolt 32 has a pin 32*a* spaced from pivot pin 35 on each side of the bolt 32 which ride in banana-type curves 32*b*, as best shown in FIGS. 9 and 10. Pins 32*a*, riding in banana-type curves 32*b*, prevent cocking of the mechanism in the event of a major force such as a fire.

Figure 11:
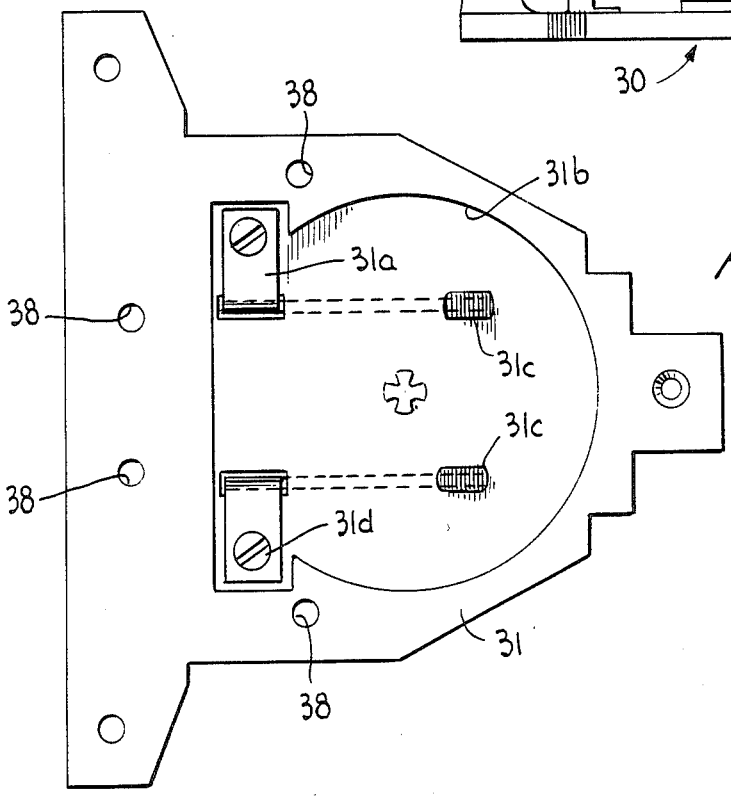
FIG. 11 is a bottom view of the latch-bolt assembly.

As illustrated in FIG. 11, the latch-bolt assembly is secured to base plate 31 on the bottom side of the base plate with stakes 31*a* which are bent over and indented into a recess 31*b* of the base plate. Additional anchoring is provided at 31*c* as best shown at FIG. 11. The anchoring of stakes 31*a* with screw means 31*d* prevents the breaking away of the latch-bolt mechanism 40 from the base plate 31, again in the event of a major force such as a fire.

Strike assembly 50 includes anchoring or base plate 52 having a plurality of holes or slots 58 for mounting the assembly to a frame member. The assembly also includes recesses 54 and 56 for receiving projections 34 and 36 of the latch-bolt assembly 30. As illustrated, the recesses 54 and 56 are wider than projections 34 and 36, permitting limited vertical movement of the projections in the recesses. Assembly 50 also includes slot 51 and ramp 53 for receiving and retaining latch bolt 32, thereby holding the door closed.

As is apparent, front or base plate 31 constructed integrally with lugs or projections 34 and 36 can be conveniently manufactured as a unitized structure from a rigid metal. The latch-bolt assembly which is mounted on base plate 31 in accordance with the present invention can, in general, be any of the prior art latch-bolt assemblies such as shown and described in Williams, U.S. Pat. No. 3,877,262 assigned to the assignee of the present application, incorporated herein by reference. The latch-bolt assembly as illustrated in the drawing, however, is unique in view of the manner of anchoring the latch-bolt mechanism 40 to the base plate 31 by means of stakes 31*a;* in view of the manner of securing the latch-bolt 32 to the mechanism with pins 32*a* riding in curves 32*b*, and in the manner of securing the base plate 30 to the door member 10 at points directly opposite of the pivot pin 35 through holes 38. The strike assembly is also of unitized construction from a rigid metal.

Figure 12:
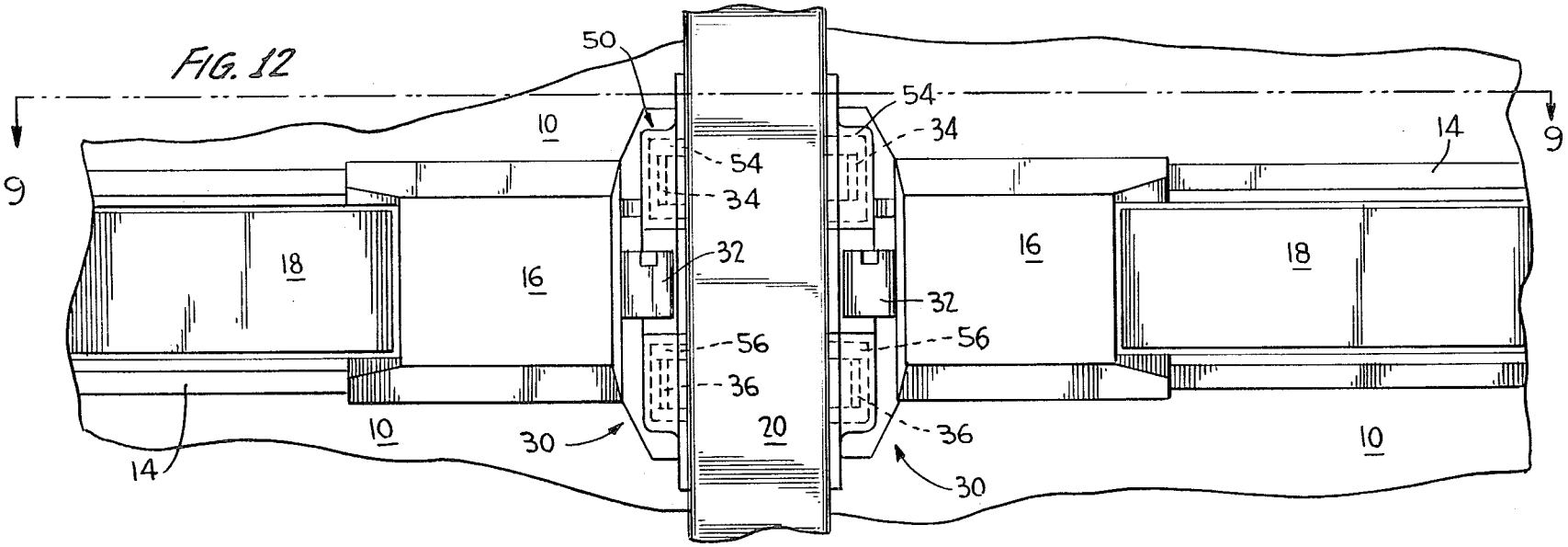
FIG. 12 is an elevational view illustrating the exit device of the present invention on double doors.
Figure 13:
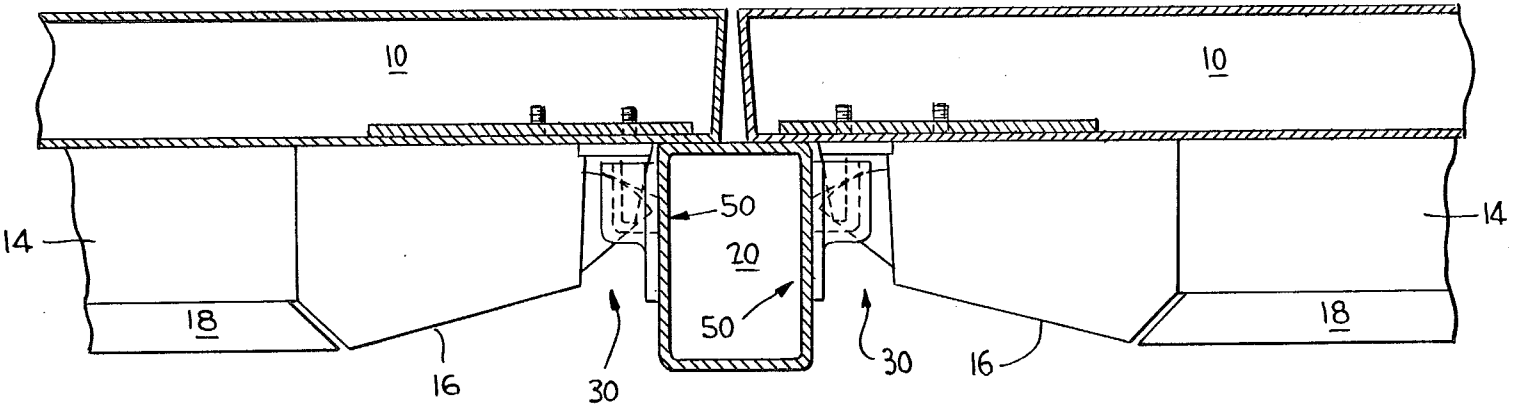
FIG. 13 is a sectional view taken along line 12—12 of FIG. 12.

FIGS. 12 and 13 are views similar to the views of FIGS. 1 and 3; however, in FIGS. 12 and 13 a double door assembly is illustrated. As shown in FIGS. 12 and 13, a strike assembly 50 is attached to opposite surfaces of mullion 20 for engagement with latch-bolt assembly 30.

Figure 5:
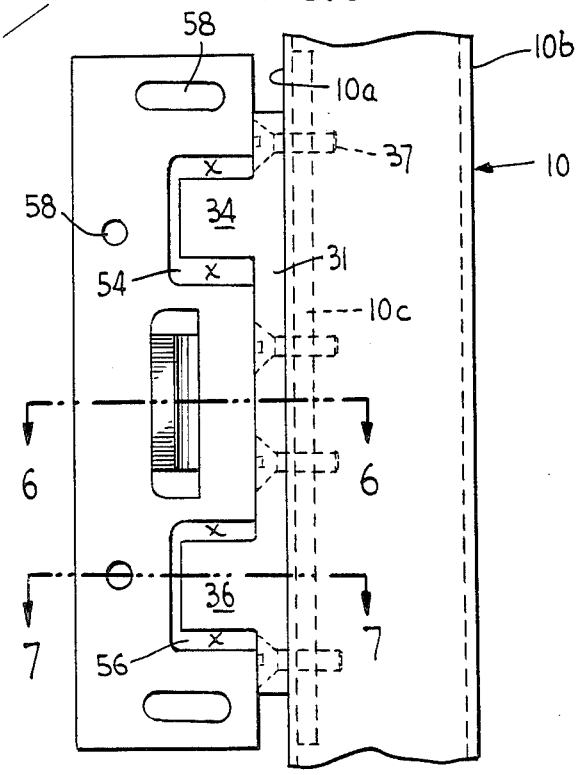
FIG. 5 is a sectional view taken along line 5—5 of FIG. 3.
Figure 6:
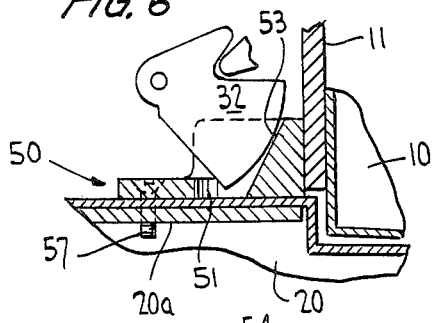
FIG. 6 is a sectional view taken along line 6—6 of FIG. 5.
Figure 7:
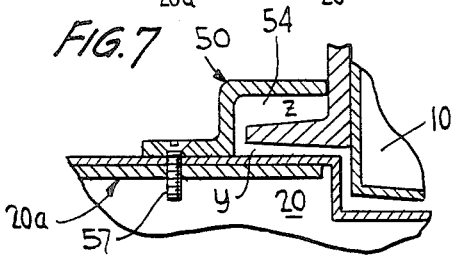
FIG. 7 is a sectional view taken along line 7—7 of FIG. 5.

The operation of the exit device of the present invention is best shown in FIGS. 5, 6, and 7. As shown, a door 10 has mounted on surface 10*a* a latch-bolt assembly 30 with fasteners 37. As best shown in FIG. 5, the door has a reinforcing plate 10*c*. To a door frame member 20 having a reinforcing plate 20*a* is attached a strike assembly 50 with fasteners 57. As best shown in FIG. 6, latch-bolt 32 by engagement with slot 51 and ramp 53 locks the door to the frame member. As shown in FIG. 5, when the door and frame are in locking engagement, projections 34 and 36 have space X for limited vertical movement within recesses 54 and 56. As shown in FIG. 7, the latch member 36 has space Y for limited inward lateral movement and space Z for limited outward lateral movement within recess 54.

In normal operations, the exit device of the present invention functions similar to any conventional mated latch bolt and strike assembly. However, when the presently disclosed device is subjected to a major distorting force of a type which normally will cause a hinging-type of action that can cause latch disengagement from the strike by the introduction of a camming angle, projections 34 and 36 on front plate 31 prevent door 10 from separation from the mullion 20 when the mullion bows toward the fire in the latched area by engaging the walls of recesses 54 and 56 in the strike assembly, forcing door 10 to move with mullion 20 in the same relative manner. Linear growth of mullion 20 during a fire is restricted in the latch area by projections 34 and 36 on plate 31 engaging the walls of the recesses 54 and 56 in the strike assembly, preventing excessive strain from occurring on latch bolt 32 and other components of the latch assembly as a result of the raised portions of the strike forcibly engaging the sides of the latch bolt. This restriction also prevents auxiliary latch 33 of the dead-locking mechanism from becoming disengaged from the strike projection which would allow the dead locking of the latch bolt to become inoperative. The projections limit lateral movement of the strike and mullion away from the latch assembly and by the rigid face of the latch assembly limit inward movement of the strike and mullion toward the latch assembly, thereby stabilizing the device.

The dead-locking mechanism generally illustrated in the drawing is fully illustrated and described in the aforesaid Williams, U.S. Pat. No. 3,877,262, primarily with reference to FIGS. 3 and 4 of the '262 patent as described at column 4, line 58, through column 5, line 33.

As will be apparent to one skilled in the art, various modifications can be made within the scope of the aforesaid description. Such modifications being within the ability of one skilled in the art form a part of the present invention and are embraced by the appended claims.

It is claimed:

1. A lock mechanism comprising a latch-bolt assembly and a mated strike assembly mounted on a closure frame member, said latch-bolt assembly comprising a base plate and a latch-bolt mechanism mounted on said base plate and including a latch, said base plate having means for securing said base plate to a closure such as a door and two upstanding projections, one of said upstanding projections being spaced vertically on either side of said latch of said latch-bolt mechanism and extending from the base plate in the direction of movement of said closure towards a closure frame member; said strike assembly comprising a front plate, means for securing said front plate to said closure frame member; said strike assembly having a first recess for receiving said latch and corresponding recesses for receiving said projections when the closure is closed, said corresponding recesses being spaced vertically at opposite sides of said first recess, and in generally vertical alignment therewith, the width of said corresponding recesses being substantially greater than the width of said projections to permit controlled limited vertical growth of said strike assembly and closure frame member relative to said latch, said corresponding recesses when engaged by said projections limiting further movement of said closure towards said closure frame member and said first recess when engaged by said latch limiting movement of said closure member away from said closure frame member.

2. The lock mechanism according to claim 1 wherein the depth of the corresponding recesses of the strike assembly is not substantially greater than the thickness of said projections of the base plate thereby limiting lateral movement of said projections in said recesses.

3. The lock mechanism of claim 2 wherein said latch-bolt assembly includes an auxiliary latch.

4. The lock mechanism of claim 1 wherein said latch-bolt mechanism includes a pivot pin for said latch and said means for securing said base plate to said closure includes a hole in said base plate substantially directly in alignment with said pivot pin of said latch-bolt mechanism.

5. The lock mechanism of claim 4 wherein said means for mounting said latch-bolt mechanism on said base plate includes stakes, said base plate includes openings for receiving said stakes and screw means for anchoring said stakes to said base plate.

6. The lock mechanism of claim 5 wherein the bottom of said base plate includes a recess and said stakes are bent over to be flush with said recess, and said bent-over stakes are secured to said base plate with screw means.

7. The lock mechanism of claim 6 wherein said latch-bolt mechanism includes pins spaced from said pivot pin and said latch-bolt mechanism includes curved slots for receiving said pins.

8. An exit assembly comprising an outwardly opening closure means and a cooperative a closure frame member, said closure means having secured to the inside surface thereof a latch-bolt assembly, said closure frame member having secured thereto a strike assembly mated to said latch-bolt assembly, said latch-bolt assembly comprising a base plate secured to said closure means and a latch-bolt mechanism including a latch and mounting means for mounting on said base plate, said base plate having two upstanding projections thereon extending from the base plate in the direction of movement of said closure towards said closure frame member, one of said upstanding projections being spaced vertically on either side of said latch of said latch-bolt mechanism, said strike assembly comprising a front plate secured to said closure frame member; said strike assembly having a first recess for receiving said latch and corresponding recesses for receiving said upstanding projections when the closure is closed, said corresponding recesses being spaced vertically at opposite sides of said first recess and in generally vertical alignment therewith, the width of said corresponding recesses being substantially greater than the width of said projections to permit controlled limited vertical growth of said strike assembly and closure frame member relative to said latch, said corresponding recesses when engaged by said projections limiting further movement of said closure towards said closure frame member and said first recess when engaged by said latch limiting movement of said closure member away from said closure frame member.

9. The exit assembly of claim 8 wherein the depth of the corresponding recesses of the strike assembly is not substantially greater than the thickness of said projections of the base plate thereby limiting lateral movement of said projections in said recesses.

10. The exit assembly of claim 9 wherein said latch-bolt assembly includes an auxiliary latch.

11. The exit assembly of claim 8 wherein said latch-bolt mechanism includes a pivot pin for said latch and said means for securing said base plate to said closure includes a hole in said base plate substantially directly in alignment with said pivot pin of said latch-bolt mechanism.

12. The exit assembly of claim 11 wherein said means for mounting said latch-bolt mechanism on said base plate includes stakes, said base plate includes openings for receiving said stakes and screw means for anchoring said stakes to said base plate.

13. The exit assembly of claim 12 wherein the bottom of said base plate includes a recess and said stakes are bent over to be flush with said recess, and said bent-over stakes are secured to said base plate with screw means.

14. The exit assembly of claim 13 wherein said latch-bolt mechanism includes pins spaced from said pivot pin and said latch-bolt mechanism includes curved slots for receiving said pins.

15. A lock mechanism in accordance with claim 3 wherein one of the walls defining one of the corresponding recesses is horizontally aligned with said auxiliary latch irrespective of the limited vertical growth of said strike assembly and closure frame member.

16. An exit assembly in accordance with claim 10 wherein one of the walls defining one of the corresponding recesses is horizontally aligned with said auxiliary latch irrespective of the limited vertical growth of said strike assembly and closure frame member.

* * * * *